US009383169B2

(12) United States Patent
Donovan

(10) Patent No.: US 9,383,169 B2
(45) Date of Patent: Jul. 5, 2016

(54) COMPOUND BOW MOUNT

(71) Applicant: Ken W. Donovan, Agua Dulce, CA (US)

(72) Inventor: Ken W. Donovan, Agua Dulce, CA (US)

( * ) Notice: Subject to any disclaimer, the term of this patent is extended or adjusted under 35 U.S.C. 154(b) by 85 days.

(21) Appl. No.: 14/107,277

(22) Filed: Dec. 16, 2013

(65) Prior Publication Data

US 2015/0168104 A1 Jun. 18, 2015

(51) Int. Cl.
*F41G 1/467* (2006.01)
*F41G 1/34* (2006.01)

(52) U.S. Cl.
CPC ..... *F41G 1/467* (2013.01); *F41G 1/345* (2013.01)

(58) Field of Classification Search
CPC ..... F41G 1/467
USPC ..... 33/265; 124/87
See application file for complete search history.

(56) References Cited

U.S. PATENT DOCUMENTS 3,271,863 A * 9/1966 Harrington ..... 33/265
4,291,469 A * 9/1981 Weast ..... 33/265
5,228,204 A * 7/1993 Khoshnood ..... 33/265
5,495,675 A * 3/1996 Huang ..... 42/115
6,366,344 B1 * 4/2002 Lach ..... 356/3.1
6,644,297 B1 * 11/2003 Brown, Jr. ..... 124/87
7,255,035 B2 * 8/2007 Mowers ..... 89/41.05
7,832,109 B2 * 11/2010 Gibbs et al. ..... 33/265
8,215,024 B1 * 7/2012 Terzo ..... 33/265
8,619,238 B2 * 12/2013 Overstreet ..... 356/4.01
8,677,637 B2 * 3/2014 Willis ..... 33/265
2014/0144030 A1 * 5/2014 Heaton et al. ..... 33/228
2015/0040409 A1 * 2/2015 Morrison ..... 33/228

* cited by examiner

*Primary Examiner* — Christopher Fulton
(74) *Attorney, Agent, or Firm* — John R. Ross, III; John R. Ross

(57) ABSTRACT

A bow mount for a bow. A mount bracket is rigidly attached to a mount attachment side. A lateral adjustment piece is slidingly attached to the mount bracket. A position locking mechanism rigidly holds the lateral adjustment piece in a desired position. A device attachment rail is connected to the lateral adjustment piece. A device is connected to the device attachment rail. The device attachment rail does not extend beyond the planar surface of the bow's line of sight side. This allows for the archer to have a line of sight unobstructed by the bow mount. In a preferred embodiment the bow is a compound bow, the device attachment rail is a Picatanny rail and the attached device is a red dot sight.

10 Claims, 8 Drawing Sheets

COMPOUND BOW MOUNT

The present invention relates to bows, and in particular to compound bows and methods for mounting accessories to compound bows.

BACKGROUND OF THE INVENTION

The sport of archery is very well known. In archery a bow is used to shoot arrows at a target. Bows are also used for recreation, competition and hunting. There are various types of bows. For example, there are straight bows, recurve bows and compound bows. A compound bow is a modern bow that uses a levering system, usually of cables and pulleys, to bend the limbs. In modern times, users of compound bows are interested in improving their power, range and accuracy. To improve accuracy archers may decide to mount a compound bow sight to their bow. Prior art mounts are faulty in that they often are bulky and obstructive to the archer. Additionally, bow sights used with prior art mounts are complicated to use, install, adjust and calibrate.

Existing compound bow mounts accept prior art sights that are complicated to use. The prior art compound bow sights require multiple points of reference for target acquisition. The points of reference are: 1) the archer's eye, 2) a peep sight mounted in the bow string (rear sight), 3) a pin sight mounted on the bow riser (front sight)—note, there are multiple sight pins in the pin sight configured very closely together to compensate for arrow trajectory, all requiring individual alignment, and 4) the target.

Furthermore, it should be noted that prior art bow sights associated with prior art mounts require tedious adjustment, called zeroing, of all the components and is subject to misalignment and parallax errors. Also, shooting in cloudy, rainy or low ambient light conditions further exacerbates the ineffectiveness of the prior art mount and associated sight technology.

The Weaver rail is known. A Weaver rail is a system to connect telescopic sights and other accessories to rifles, shotguns, pistols, and crossbows. It uses a pair of parallel rails and several slots perpendicular to these rails The Picatanny rail is known. The Picatinny rail, also known as a MIL-STD-1913 rail, STANAG 2324 rail, or tactical rail, is a bracket used on some firearms in order to provide a standardized mounting platform for accessories and attachments, similar to the Weaver rail mount.

What is needed is a better bow sight mount and one that provides an unobstructed view of the target.

SUMMARY OF THE INVENTION

The present invention provides a bow mount for a bow. A mount bracket is rigidly attached to a mount attachment side. A lateral adjustment piece is slidingly attached to the mount bracket. A position locking mechanism rigidly holds the lateral adjustment piece in a desired position. A device attachment rail is connected to the lateral adjustment piece. A device is connected to the device attachment rail. The device attachment rail does not extend beyond the planar surface of the bow's line of sight side. This allows for the archer to have a line of sight unobstructed by the bow mount. In a preferred embodiment the bow is a compound bow, the device attachment rail is a Picatanny rail and the attached device is a red dot sight.

DETAILED DESCRIPTION OF THE PREFERRED EMBODIMENTS

Figure 1:
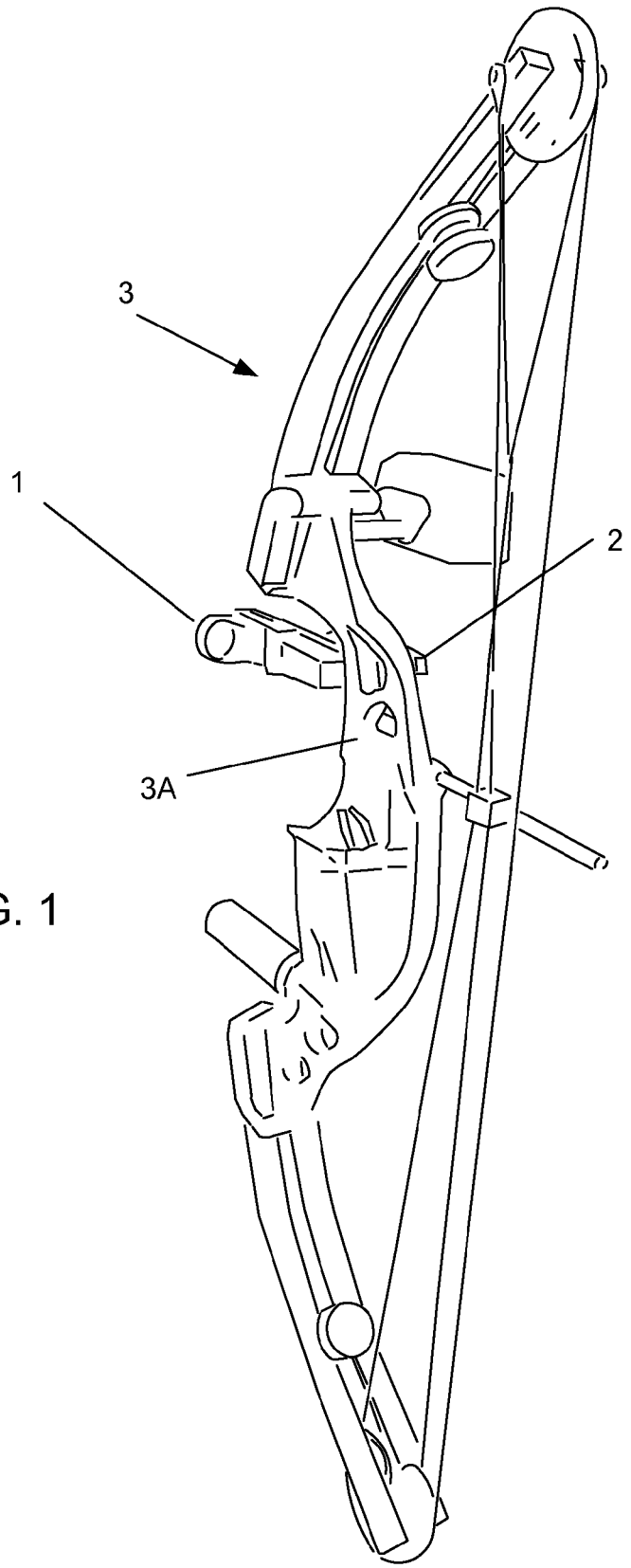
FIG. 1 shows a red dot sight mounted to a compound bow using a preferred embodiment of the present invention.
Figure 2:
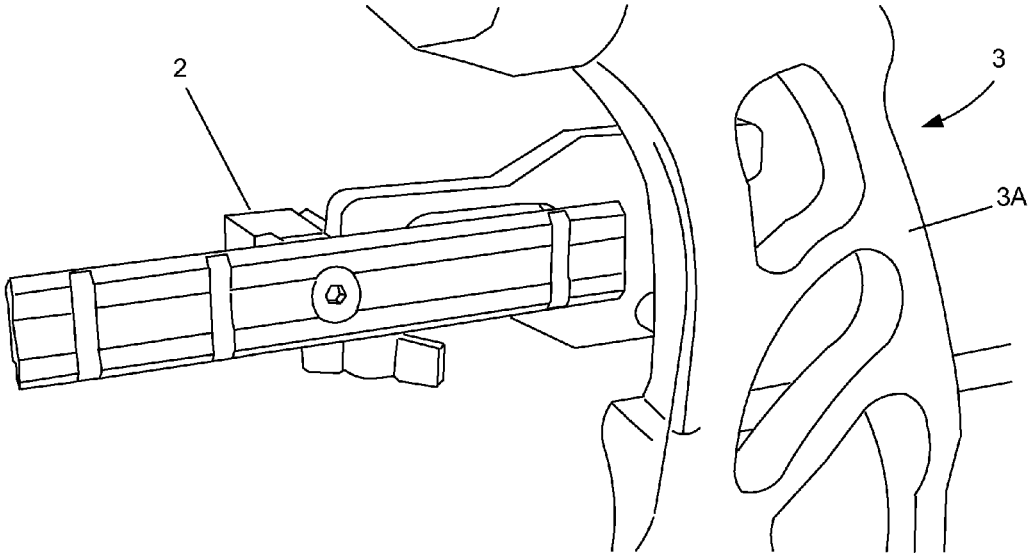
FIG. 2 shows a preferred embodiment of the present invention mounted to a compound bow.

FIGS. 1-2 show compound bow mount 2 that is minimally obstructive to the archer. This allows the archer to attach devices to the compound bow mount in such a manner so that optimum shooting is achieved in that the mount is positioned so that it does not obstruct the archer. Furthermore, compound bow mount 2 allows for the easy and efficient attachment of red dot sight 1. The utilization of red dot sight 1 is a vast improvement over the prior art compound bow sights. With red dot sight 1, target acquisition is much faster and easier. Also, the archer can shoot with both eyes open, using his peripheral vision, which reduces the problems associated with the "dominant eye".

Figure 8:
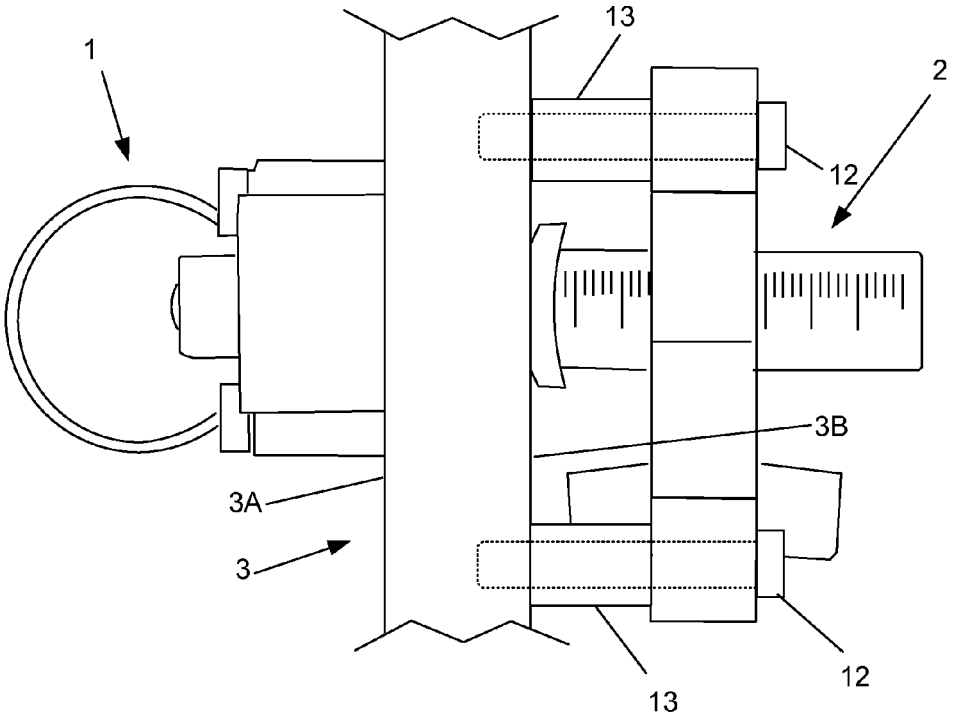
FIG. 8 shows a preferred embodiment of the present invention mounted to a compound bow.

FIG. 1 shows a preferred embodiment of the present invention in which red dot sight 1 is attached to mount 2 as shown. Compound bow 3 is a right-handed bow where the archer draws the string back with his right hand. It should be noted that mount 2 is mounted on mount attachment side 3B (FIG. 8) of compound bow 3 (FIG. 2) which allows for red dot sight 1 to be precisely positioned along the archer's line of sight so that there is no interference from mount 2 with the arrow as it is being shot. For example, a right handed archer will place mount 2 (FIG. 8) on mount attachment side 3B of compound bow 3. Line of sight side 3A of compound bow 3 is completely unobstructed by mount 2. FIGS. 2 and 8 show that Picatinny rail 8 does not extend beyond the planar surface of line of sight side 3A. Line of sight side 3A is the side of the bow where the arrow is positioned and is the archer's line of sight side. Therefore, mount 2 is completely not obstructing the archer.

Preferred Embodiment of the Present Invention

Figure 3:
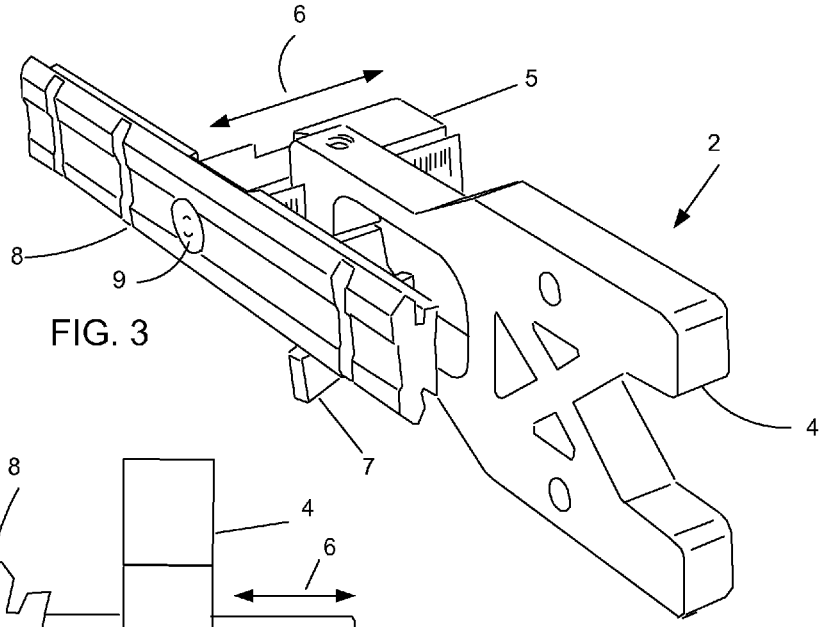
FIGS. 3-5 show a preferred embodiment of the present invention.
Figure 4:
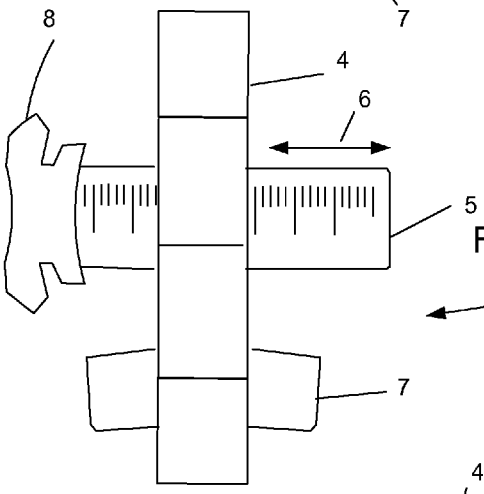
Figure 5:
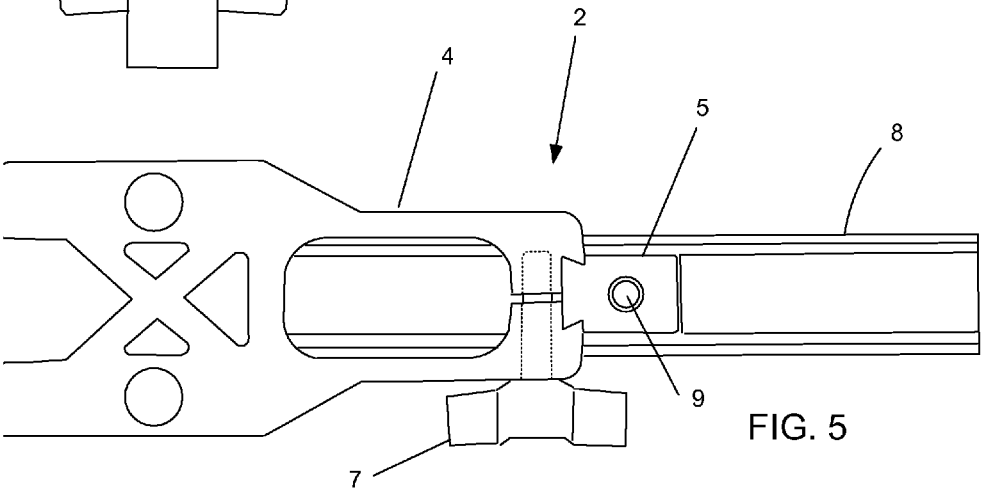

FIGS. 3-5 show preferred compound bow mount 2. Mount 2 is preferably fabricated from a light weight strong material, such as light weight aluminum or composite carbon fiber. Bracket 4 is slidingly attached to lateral adjustment piece 5. Lateral adjustment piece 5 can be slid side-to-side in the direction indicated by arrow 6. Once lateral adjustment piece 5 is in the desired position, knob 7 is turned to tighten bracket 4 so that lateral adjustment piece 5 is held firmly in place. Knob 7 functions as a position locking mechanism to hold the position of lateral adjustment piece 5. Picatinny rail 8 is rigidly connected to lateral adjustment piece 5 via hex screw 9.

Attaching a Device to the Compound Bow Mount

Figure 6:
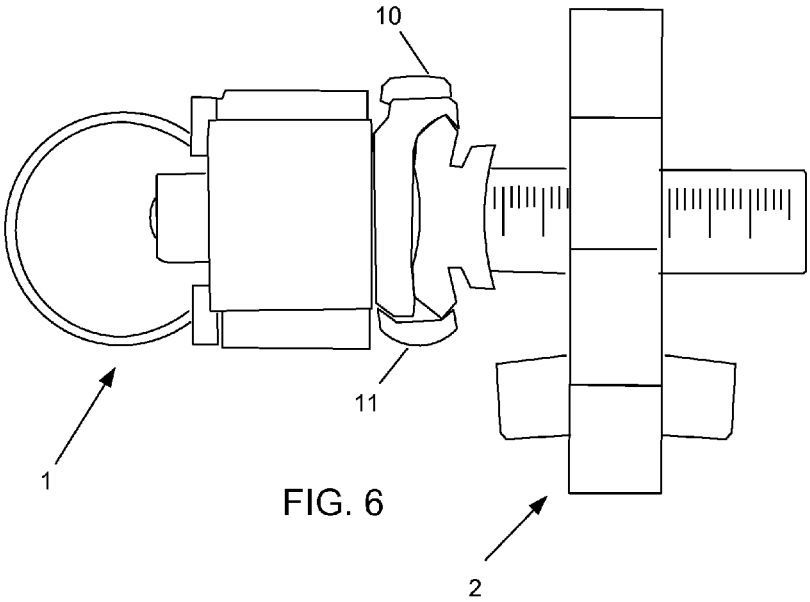
FIGS. 6-7 show a red dot sight mounted to a preferred embodiment of the present invention.
Figure 7:
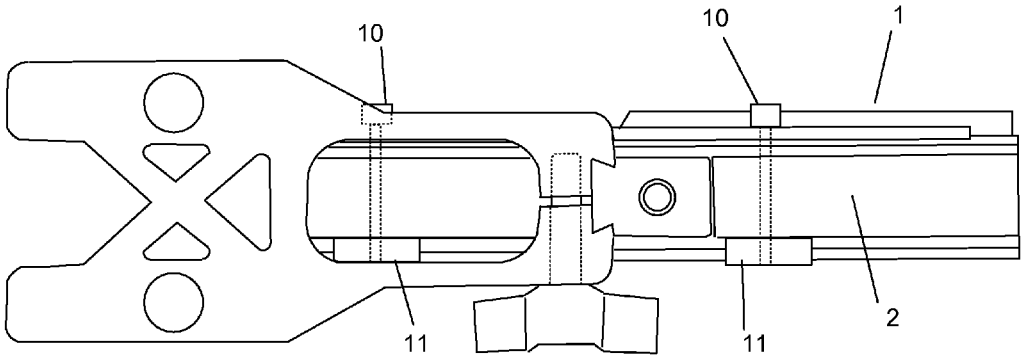

FIGS. 6 and 7 show red dot sight 1 rigidly attached to mount 2 by utilization of hex bolts 10 and nuts 11. After connection to mount 2, red dot sight 1 is ready for attachment to compound bow 3.

Connecting Mount to Compound Bow

FIG. 8 shows mount 2 connected to compound bow 3. Hex bolts 12 are inserted through pre drilled holes in mount 2 and then through spacers 13. Finally, they are screwed tightly into predrilled holes in compound bow 3. Spacers 13 keep mount 2 at a predetermined distance from compound bow 3. Compound bow now has red dot sight 1 attached as shown in FIGS. 1 and 8. The bow is now ready for use.

Other Preferred Embodiment

Figure 9:
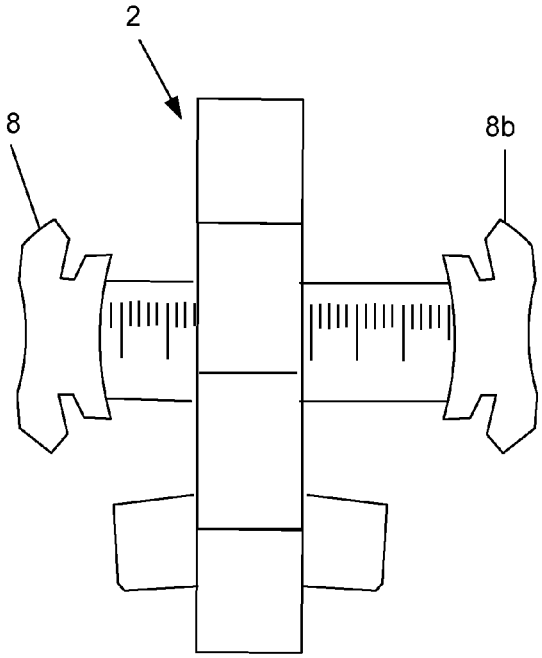
FIG. 9 shows another preferred embodiment of the present invention.

FIG. 9 shows another preferred embodiment of the present invention in which a second Picatinny rail 8*b* is rigidly connected to lateral adjustment piece 5 as shown. Rail 8*b* allows for the attachment of a second device. For example, in one preferred embodiment a red dot sight is attached to rail 8 and a digital video camera is attached to rail 8*b*. Other devices that could also be simultaneously attached include a digital camera, laser, or other illuminating device such as a flashlight.

Left Handed Bow

Figure 10:
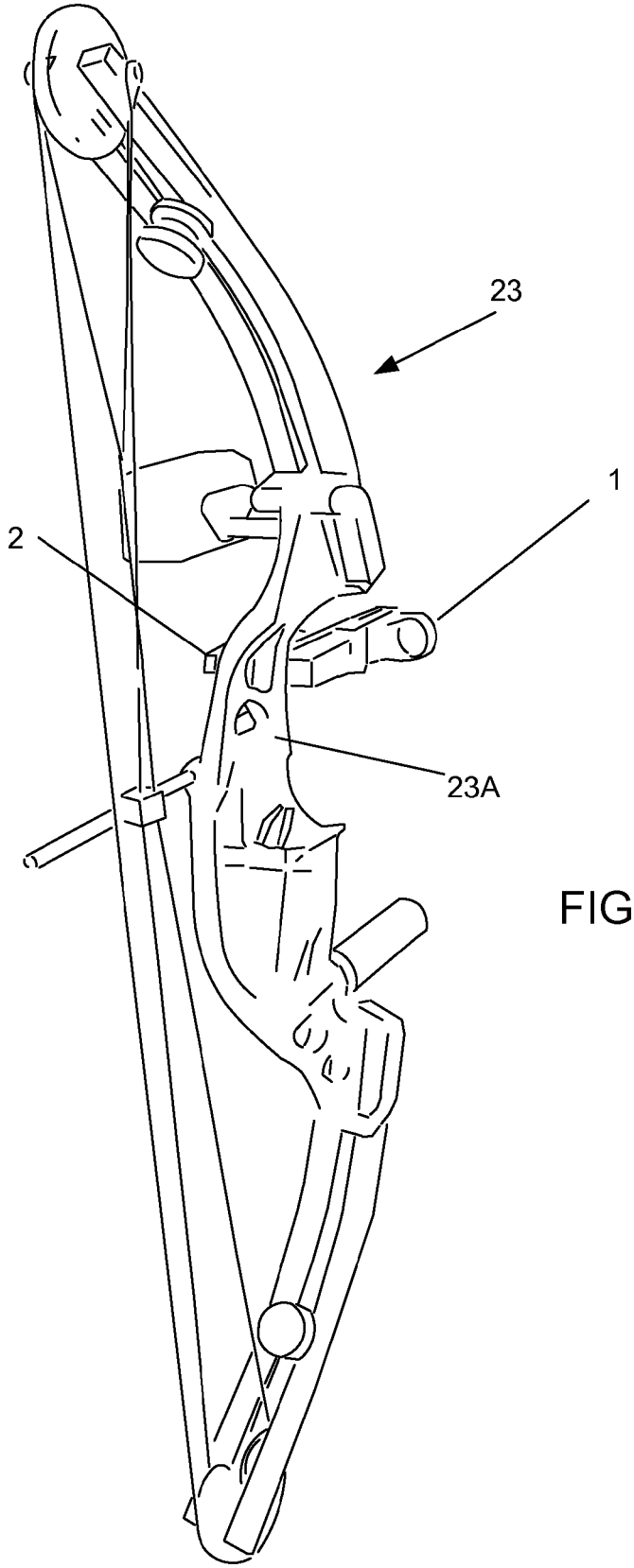
FIGS. 10-11 shows a preferred embodiment of the present invention utilized with a left handed compound bow.
Figure 11:
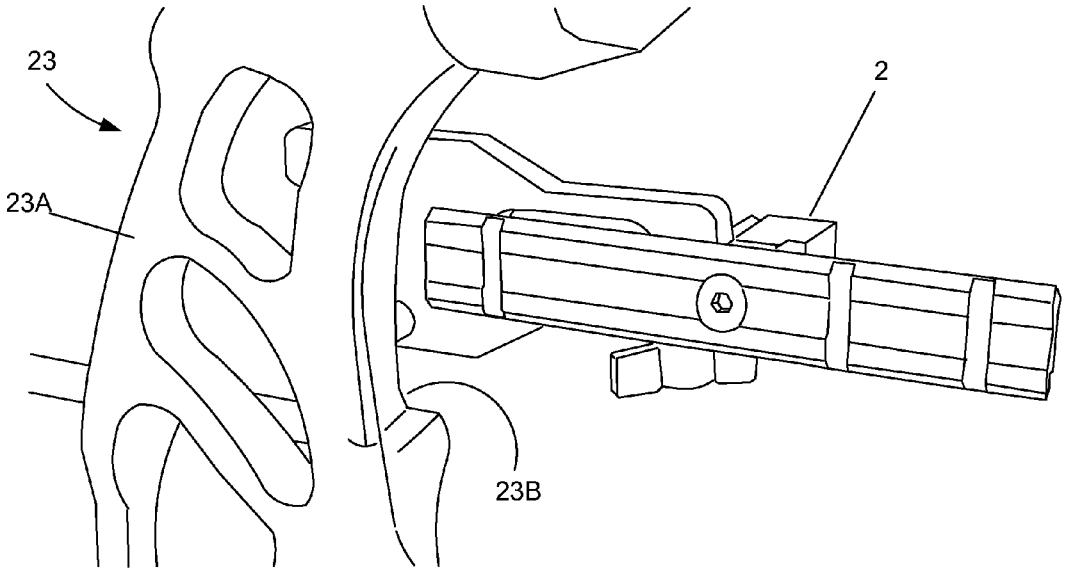

FIGS. 1-9 discuss the utilization of a right handed compound bow. However, it would be possible to attach mount 2 to a left handed bow as well. For example, FIGS. 10-11 show mount 2 attached to left handed compound bow 23. Compound bow 23 is a left-handed bow where the archer draws the string back with his left hand. It should be noted that mount 2 is mounted on mount attachment side 23B (FIG. 11) of compound bow 23 (FIG. 10) which allows for red dot sight 1 to be precisely positioned along the archer's line of sight so that there is no interference from mount 2 with the arrow as it is being shot. For example, line of sight side 23A of compound bow 3 is completely unobstructed by mount 2. FIGS. 10 and 11 show that Picatinny rail 8 does not extend beyond the planar surface of line of sight side 23A. Line of sight side 23A is the side of the bow where the arrow is positioned and is the archer's line of sight side. Therefore, mount 2 is not obstructing the archer.

Other Preferred Embodiment

Figure 12:
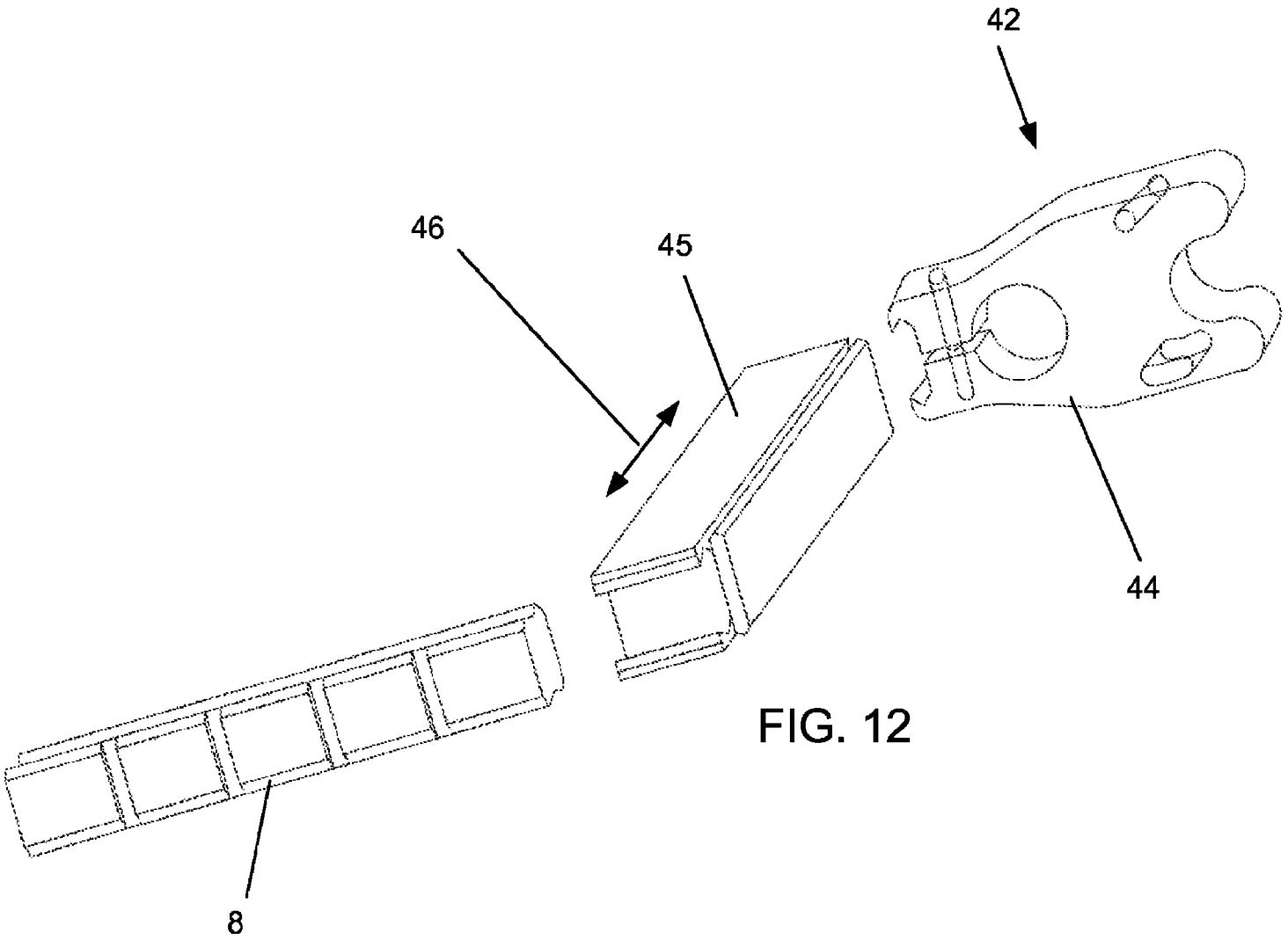
FIG. 12 shows another preferred embodiment of the present invention.

It should be understood that other mounts similar to mount 2 can also be fabricated. For example, FIG. 12 shows another preferred embodiment of the present invention. Mount 42 is preferably fabricated from a light weight strong material, such as light weight aluminum or composite carbon fiber. Bracket 44 is slidingly attached to lateral adjustment piece 45. Lateral adjustment piece 45 can be slid side-to-side in the direction indicated by arrow 46. Once lateral adjustment piece 45 is in the desired position, a knob is turned to tighten bracket 44 so that lateral adjustment piece 45 is held firmly in place (in a fashion similar to that described above in reference to the earlier preferred embodiment). The knob functions as a position locking mechanism to hold the position of lateral adjustment piece 5. Picatinny rail 8 is rigidly connected to lateral adjustment piece 45 via a hex screw (not shown).

- - -

While the present invention has been described in terms of preferred embodiments, the reader should consider these described embodiments only as particular embodiments.

Many other embodiments are possible. For example, although the above preferred embodiments described the utilization of a Picatinny rail, it would be possible to utilize other types of rails as well, such as a Weaver rail or a NATO Accessory Rail (NAR). Also, although the above preferred embodiments discussed the attachment of mount 2 to a compound bow, it would be possible to attach mount to all types of bows, including right or left handed bows. Therefore, the reader should determine the scope of the present invention by the claims and their legal equivalents.

What is claimed is:

1. A bow mount for a bow having a mount attachment side and a line of sight side, comprising:

A. a mount bracket rigidly attached to said mount attachment side,

B. a lateral adjustment piece slidingly attached to said mount bracket,

C. a position locking mechanism for rigidly holding said lateral adjustment piece in a desired position, D. a device attachment rail connected to said lateral adjustment piece, E. a second device attachment rail connected to said lateral adjustment piece, F. a device connected to said device attachment rail, wherein said device attachment rail does not extend beyond the planar surface of said line of sight side allowing for the archer to have a line of sight unobstructed by side bow mount.

2. The bow mount as in claim 1, further comprising spacers rigidly connected between said mount bracket and said mount attachment side.

3. The bow mount as in claim 1, wherein said position locking mechanism is a knob.

4. The bow mount as in claim 1, wherein said device attachment rail is a Picatinny rail.

5. The bow mount as in claim 1, wherein said device attachment rail is a Weaver rail.

6. The bow mount as in claim 1, wherein said device attachment rail is a NATO accessory rail.

7. The bow mount as in claim 1, wherein said device attached to said device attachment rail is a red dot sight.

8. The bow mount as in claim 1 wherein said bow is a compound bow.

9. The bow mount as in claim 1 wherein said bow is a right handed bow.

10. The bow mount as in claim 1 wherein said bow is a left handed bow.

* * * * *